US005987933A

United States Patent [19]

Metzler

[11] Patent Number: 5,987,933

[45] Date of Patent: Nov. 23, 1999

[54] ELASTIC TAN-THROUGH GARMENT

[75] Inventor: Josef Metzler, Bregenz, Austria

[73] Assignee: Wolford Aktiengesellschaft, Bregenz, Austria

[21] Appl. No.: 09/202,473

[22] PCT Filed: Jun. 10, 1997

[86] PCT No.: PCT/AT97/00120

§ 371 Date: Dec. 14, 1998

§ 102(e) Date: Dec. 14, 1998

[87] PCT Pub. No.: WO97/47793

PCT Pub. Date: Dec. 18, 1997

[30] Foreign Application Priority Data

Jun. 13, 1996 [AT] Austria ..... 1042/96

[51] Int. Cl.[6] ..... A41D 5/00; D04B 7/16; D02G 3/36; D03D 3/00

[52] U.S. Cl. ..... 66/202; 2/67; 57/226; 428/229

[58] Field of Search ..... 8/925, 926; 2/67; 66/202, 171, 189; 442/60, 131, 187; 428/229; 52/226

[56] References Cited

U.S. PATENT DOCUMENTS

| | | | |
|---|---|---|---|
| 3,425,246 | 2/1969 | Knohl | 66/171 |
| 3,651,670 | 3/1972 | Burleson et al. | 66/177 |
| 3,933,013 | 1/1976 | Cassidy | 66/177 |
| 3,940,917 | 3/1976 | Strachan | 57/152 |
| 4,106,313 | 8/1978 | Boe | 66/202 |
| 4,115,615 | 9/1978 | De Buck Van Overstraeten | 428/229 |
| 4,546,493 | 10/1985 | Bortnick | 2/67 |
| 5,181,278 | 1/1993 | Peleg et al. | 2/243 |
| 5,518,798 | 5/1996 | Riedel | 428/135 |
| 5,560,192 | 10/1996 | Frith | 57/226 |

FOREIGN PATENT DOCUMENTS

| | | | |
|---|---|---|---|
| 0599266 A1 | 6/1994 | European Pat. Off. | D04B 1/24 |
| 2161508 | 1/1986 | United Kingdom | D03D 15/00 |

*Primary Examiner*—John J. Calvert
*Assistant Examiner*—Robert H Muromoto, Jr.
*Attorney, Agent, or Firm*—Karl Hormann

[57] ABSTRACT

Garment snugly fitting to a body, in particular a bathing suit, having a front section (1), a back section (2), a crotch section (4) and at least one suspended section (5), the front section and the back section being circularly knitted substantially in a hose-like configuration from elastic yarn which over the extend of the garment is knitted at different tensions and/or mesh sizes, so that the garment follows the contour of the body, the elastic yarn in each row consisting of an elastic core yarn and at least one surface yarn covering it.

8 Claims, 1 Drawing Sheet

ELASTIC TAN-THROUGH GARMENT

BACKGROUND OF THE INVENTION

1. Field Of The Invention

The invention relates to a garment fitting snugly to a body, in particular a bathing suit having a front section, a back section, a crotch section and at least one suspender section, the front section and the back section being circularly knitted in a substantially hose-like fashion from elastic yarn which over the extend of the garment is knitted at different tension and/or mesh size so that the garment follows the contour of the body, the elastic yarn in each row consisting of an elastic core yarn and at least one surface yarn covering 2. The Prior Art As a rule, in garments, particularly in bathing suits which are to fit snugly to the body of their wearer, front and back sections are made of two parts which are sewn together at their side. Openings at least in the region of the upper thighs or hips and at shoulder sections are fabricated manually. Such a design suffers from the disadvantage of being very labor intensive because front and back sections have first to be cut and sewn together so as to conform to a body and before they are sewn together. The seems are bothersome and impede an optimal fit of the garment on the body. Finally, the desired snug fit of the garment to a body and its elasticity are not always ensure because of the hitherto used yarns and because the cloth is usually stretched on a frame and subjected to a heat-treatment whereby the memory of the cloth and of the garment made with it are reduced.

A garment of the kind mentioned in the introduction is also known from EP-A1-0,599,266, which may also be used as underwear and which is provided with long sleeves, the garment being provided with zones of different knits and stretch properties in its sleeves as well as in the waist and chest zones, in order to provide improved conformity to a body. Moreover, it is known from U.S. Pat. No. 3,425,246 to manufacture, for instance, of one-piece circularly knitted bathing suits, stockings, brassieres and the like with different mesh structures varying the size of the meshes in certain zones, using covered spandex yarns on circular knitting machines, for the accommodating body curves.

OBJECTS OF THE INVENTION

It is an object of the invention to provide a garment of the kind referred to in the introduction which ensure while providing an impeccable snug fit on a body may be made in a simple and cost-efficient manner in a modern production operation and which may be provided with transparent zones.

SUMMARY OF THE INVENTION

The garment in accordance with the invention is characterized by the fact that it is opaque and that it has transparent zones, whereby the elastic core yarn, preferably a spandex yarn, is covered by a polyamide yarn of fine titer applied by twisting and that in the opaque zone only an additional surface yarn of polyamide, preferably nylon, is applied to the covered elastic core yarn.

The core yarn may be covered by the finely-titered polyamide yarn in Z or S twists and may be of nylon, preferably nylon 66. The additional yarn ensures that a garment used as a bathing suit will dry quickly, is abrasion resistant and may be uniformly dyed.

The garment in accordance with the invention may be made in a manner conforming to a body by substantially a single operating cycle, so that only the crotch section, the openings in the upper thigh or hip zone and the suspended section will have to be made manually. Any cutting and sewing of the front and back section is avoided.

In accordance with a further characteristic of the invention, the entire circularly knitted garment is penetration dyed as one piece in a conventional manner. Preferably, the garment also is exhaust processed to be UV-B absorbent.

The support or core yarns used in the context of the invention preferably are spandex (elasthan) yarns such as Lycra®, which are resistant against salt water and chlorine and which are zinc-free. In the context of the invention, textured yarns, smooth yarns or highly stretched yarns such as micro fibers, multi-filament and standard filament yarns may be used as surface yarns.

The core yarn is protected either by thin yarn threads (of e.g. 16 Denier) tightly wound around it in Z or S twists (for transparent zones), or the surface yarn of polyamide (of e.g. 40 Denier) is applied by air mingling (for opaque zones). The core yarn may, however, also be provided with the surface yarn by twisting, spinning and the like. Nylon 66 (of e.g 120–140 Denier) is the preferred polyamide surface yarn or yarn thread.

It has been found that garments in accordance with the invention, the cloth of which is not tensioned over a stretch-frame, may be longitudinally stretched on an average by 140% and transversely on average by 325%.

DESCRIPTION OF THE SEVERAL DRAWINGS

The invention will be explained hereafter with reference to the drawings, in which FIG. 1 is a schematic front view and FIG. 2 is a schematic rear view of a garment serving as a bathing suit in accordance with the invention.

DETAILED DESCRIPTION OF THE PREFERRED EMBODIMENTS

Figure 2:
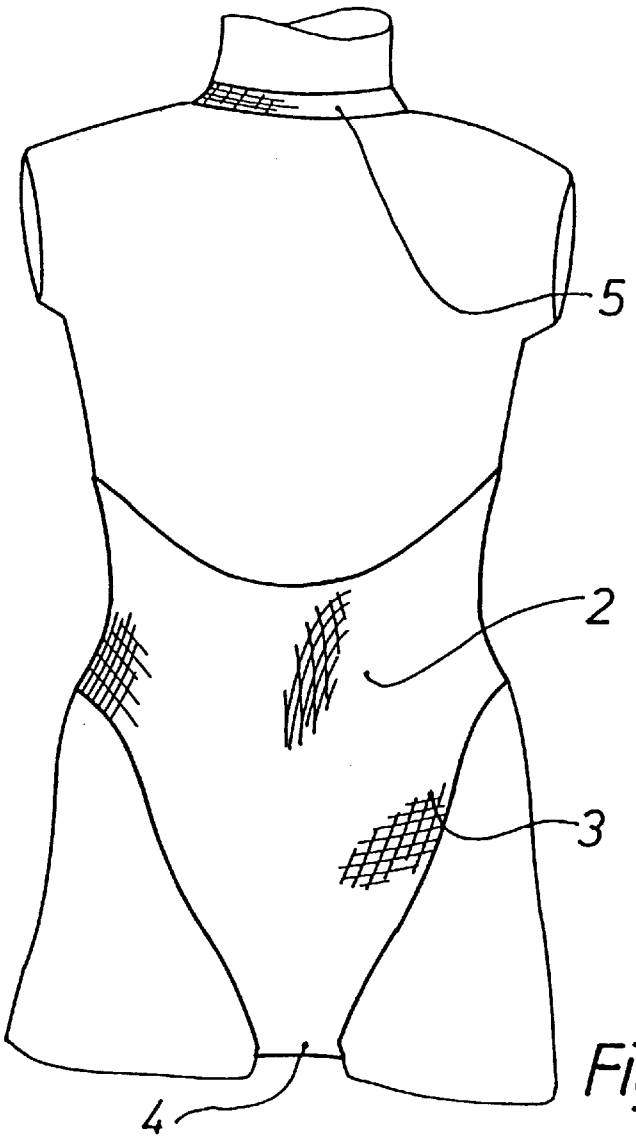
Figure 1:
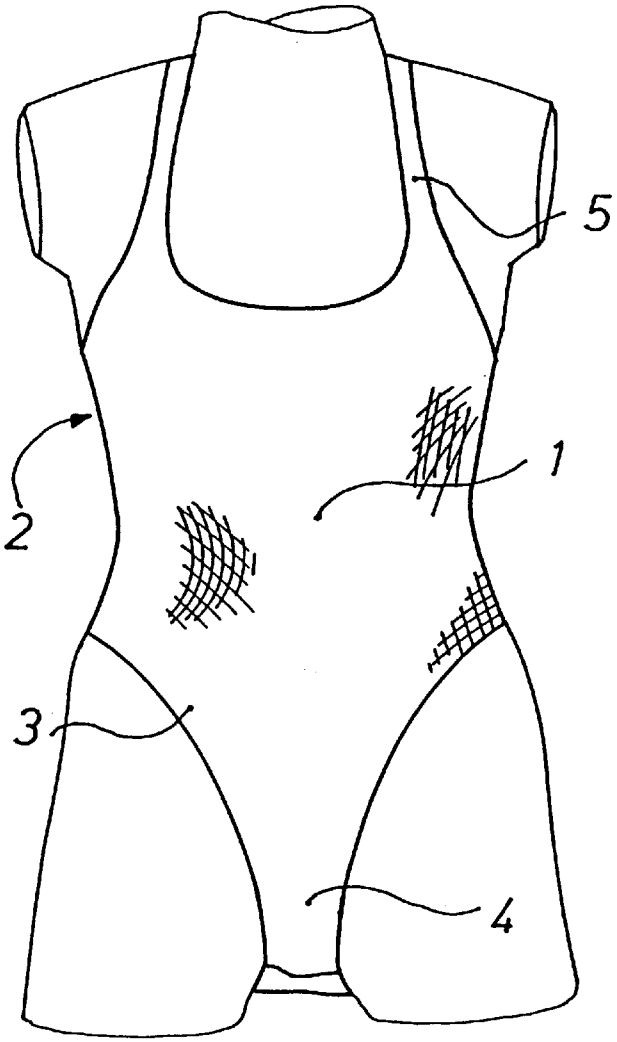

The shown opaque bathing suit consists of a front section 1 and a back section 2 integrally formed therewith by circular knitting of a hose. Openings 3 in the hip area and crotch extensions 4 defined by these sections are made manually in the conventional manner. The shoulder sections 5 are similarly made manually.

Since the bathing suit is of a one-piece construction made by a circularly knitted hose it has no seams in its circumference. The produced hose is penetration dyed.

In the circular knitting operation an elastic yarn is used for each row. In particular, the elastic yarn is provided with a core yarn, in particular spandex (e.g. Lycra®) which is saltwater and chlorine resistant and which contains no zinc and which has predetermined stress-strain properties. The spandex yarn is covered and protected by at least one surface yarn selected depending upon whether a garment is to be made with opaque and transparent zones or whether it is to be opaque all over.

In the depicted garment the core yarn is provided with a surface crimped polyamide yarn, for instance a fine fibril nylon, applied by air mingling (e.g. by an air intermingling machine), whereby the spandex yarn is pressed into the fibrils of the crimped yarn and is thus protected by the crimped yarn. This process requires setting of specific criteria such as, among others, structure and size of the air mingling jet, velocity, pressure and direction of the air current and the draft. A further surface yarn of polyamide or a yarn thread, such as nylon 66, may additionally be applied on the covered elastic core yarn.

In an opaque garment with transparent zones, not shown, the core yarn has only by a fine surface yarn of polyamide wound around it relatively tightly in left/right twists, and in the opaque region it is provided with an additional surface yarn made of polyamide such as nylon 66.

It will be understood, that within the ambit of the general inventive concept the embodiments described above may be altered, particularly in respect of the yarns used and their composition.

What is claimed is:

1. A garment of the kind fitting snugly to a body, comprising:

a front section and a back section seamlessly joined together by circular knitting of a plurality of rows of meshes of differing tensions and sizes to form a hose-like structure having first and second open ends provided with at least one transparent portion formed by an elastic core yarn covered by finely titered polyamide yarn tightly twisted around the core yarn and at least one opaque portion formed by an elastic core yarn covered by a finely titered polyamide yarn tightly twisted around the core yarn and an additional surface yarn made of polyamide applied to the covered core yarn;

means for forming a suspender section at one of the first and second open ends; and means for forming a crotch section substantially in the center of the other of the first and second open ends thereby to form two openings.

2. The garment of claim 1, wherein the elastic core yarn comprises a spandex (elasthan) yarn.

3. The garment of claim 2, wherein the polyamide yarn comprises nylon 66.

4. The garment of claim 3, wherein the polyamide yarn forms a Z twist around the core yarn.

5. The garment of claim 3, wherein the polyamide yarn forms an S twist around the core yarn.

6. The garment of claim 1, wherein the hose-like structure, the suspended section and the crotch section are penetration dyed in one piece.

7. The garment of claim 1, further comprising means for absorbing UV-B radiation.

8. The garment of claim 7, wherein the means for absorbing the UV-B radiation is applied by an exhaust process.

* * * * *